United States Patent [19]

Hicks

[11] 4,008,494

[45] Feb. 22, 1977

[54] GARMENT COLLAR PROTECTOR

[76] Inventor: Clarence W. Hicks, 12835 La Salle, Detroit, Mich. 48238

[22] Filed: Aug. 1, 1975

[21] Appl. No.: 600,945

[52] U.S. Cl. ..... 2/60

[51] Int. Cl.[2] ..... A41D 27/16

[58] Field of Search ..... 2/60, 46, 129, 142

[56] References Cited

UNITED STATES PATENTS

| | | | |
|---|---|---|---|
| 639,213 | 12/1899 | Clevenstine | 2/60 |
| 799,731 | 9/1905 | Harries | 2/60 |
| 1,153,455 | 9/1915 | Shumway | 2/60 |
| 1,258,581 | 3/1918 | Lussy | 2/60 |
| 2,634,420 | 4/1953 | Jackson | 2/60 |
| 3,088,117 | 5/1963 | Baker | 2/129 |
| 3,145,392 | 8/1964 | Lockwood et al. | 2/129 X |
| 3,200,413 | 8/1965 | Vaughan | 2/60 |
| 3,393,406 | 7/1968 | Hollinger et al. | 2/129 |

*Primary Examiner*—Thomas F. Callaghan
*Assistant Examiner*—Moshe I. Cohen
*Attorney, Agent, or Firm*—Willis Bugbee

[57] ABSTRACT

An elongated base strip of flexible fabric is adapted to be adhesively but removably secured to the neck band of a garment, such as a man's shirt. A reversely-folded absorbent collar protector strip straddles the upper edge of both sides of the base strip and on its rearward side carries an elongated narrow central attachment strip, the exposed face of which is provided with a pressure-sensitive adhesive layer and a removable cover strip. Two collar-engaging hooks are optionally fastened to the opposite ends of the rearward side of the protector strip slightly below its upper edge. Attached to and projecting laterally from the opposite ends of the forward face of the base strip are two end attachment strips similar to the central attachment strip and with their forward and rearward faces similarly provided with pressure-sensitive adhesive layers and cover strips. Attached to the front face of the base strip is a cloth facing strip, the central upper portion of which is cut away to expose the forward face of the protector strip.

3 Claims, 7 Drawing Figures

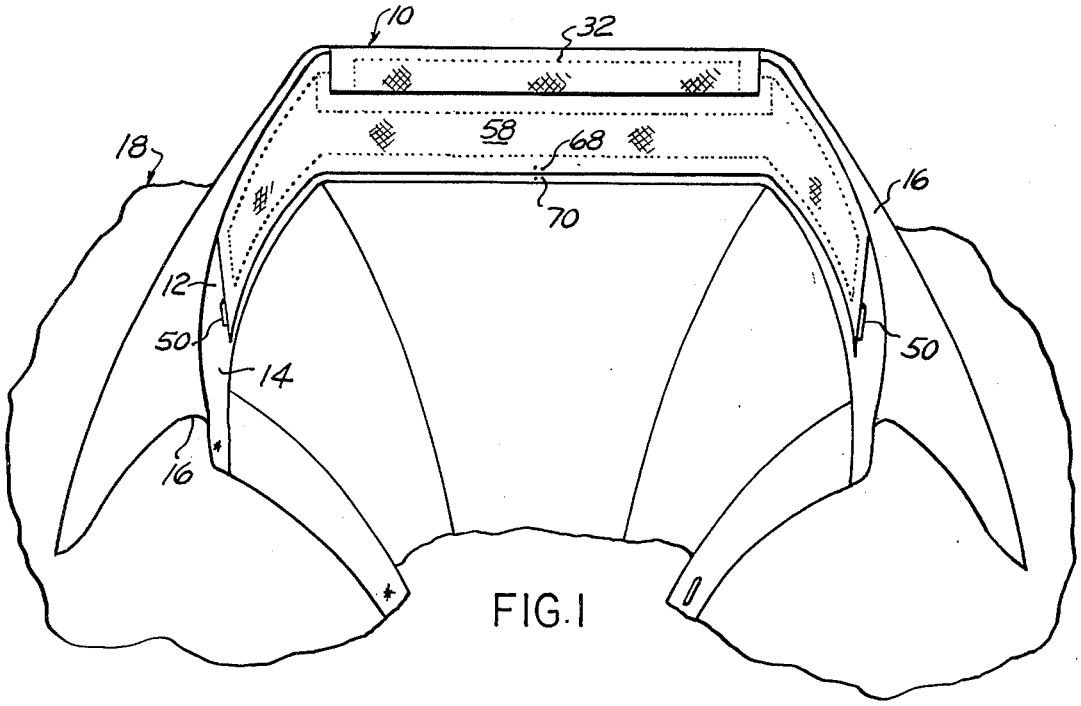
FIG.1
FIG.2
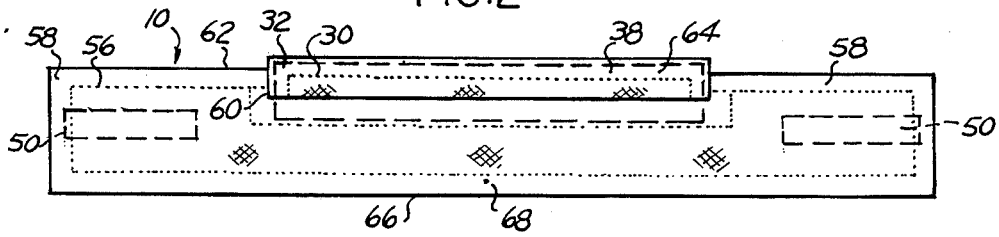
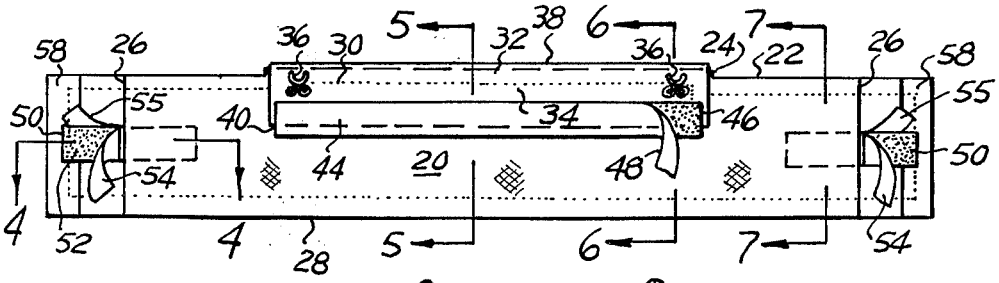
FIG.3
FIG. 4
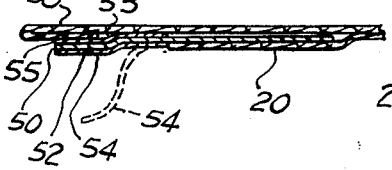
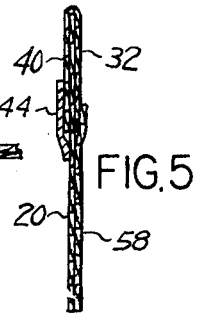
FIG.5
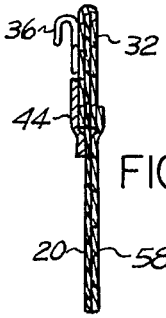
FIG.6
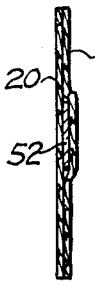
FIG.7

GARMENT COLLAR PROTECTOR

SUMMARY OF THE INVENTION

The invention particularly resides in the base strip carrying the reversely-bent protector strip and in the central and end adhesive strips by which the device is adhesively secured to the shirt collar and removed when soiled.

In the drawings,

FIG. 1 is a front elevation of the upper portion of the inside of a man's shirt with the collar thereof opened out to show, in front elevation and partly in perspective, a collar protector attached thereto according to the invention;

FIG. 2 is a front elevation of the collar protector shown in FIG. 1, removed from the shirt collar;

FIG. 3 is a rear elevation of the collar protector shown in FIGS. 1 and 2 prior to its attachment to a shirt and with the cover strips partly peeled away from the three respective adhesive layers;

FIG. 4 is an enlarged horizontal section through one of the end portions of the collar protector, taken along the line 4—4 in FIG. 3;

FIG. 5 is an enlarged vertical section taken along the line 5—5 in FIG. 3 through the center of the protector;

FIG. 6 is an enlarged vertical section taken along the line 6—6 in FIG. 3, through the end portion of the protector strip; and FIG. 7 is an enlarged vertical section taken along the line 7—7 in FIG. 3, through an end portion of the protector.

Referring to the drawing in detail, FIG. 1 shows a garment collar protector, generally designated 10, as applied to the inside surface 12 of the neck band 14 of the collar 16 of a garment 18, such as a man's shirt. The shirt 18 and its components 12, 14 and 16 are conventional and their details are beyond the scope of the present invention. The collar protector 10 (FIGS. 2 and 3) has as its foundation an elongated base strip 20 of flexible material, preferably of woven fabric having an upper edge 22 with an elongated upstanding central portion 24 (FIG. 3), opposite end edges 26 and a lower edge 28. Bent reversely over the upstanding central portion 24 and secured to the opposite sides of the base strip 20 as by stitching 30 extending therethrough is a protector strip 32 of soft, flexible moisture-absorbent material, preferably fabric. Optionally sewn or otherwise secured to the rearward face 34 of the protector strip 32 near the opposite ends thereof are two collar-engaging hooks 36 having their upper or hook portions disposed slightly below the upper edge 38 of the protector strip 32 (FIG. 3). Also secured to the protector strip 32 and base strip 20 in overlapping relationship to the lower edge 40 of the rear face 34 of the protector strip 32 is a central attachment strip 44 having an outwardly-facing pressure-sensitive adhesive layer 46 protected by a removable cover strip 48 which may be easily peeled off.

Similarly attached to the opposite end portions of the base strip 20 and projecting beyond the opposite ends 26 thereof are two end attachment strips or tabs 50 also provided on their front and back faces with layers 52 and 53 of pressure-sensitive adhesive similarly protected by end cover strips 54 and 55 which may similarly be peeled off before attaching the protector 10 to the shirt 18.

Attached to the assembly thus described on the front face thereof (FIG. 2), as by the stitching 56, is a facing strip 58 of soft thin cloth or other suitable fabric, thereby covering the front face of the base strip 20 and projecting beyond the opposite ends 26 thereof. The facing strip 58 has an elongated rectangular cutaway or notched-out portion 60 extending downward from its upper edge 62 so as to expose the front face 64 of the protector strip 32 (FIG. 2). The facing strip 58 in the center of its lower edge 66 is provided with an index mark 68 for the purposes of aligning the device 10 with a corresponding mark or dot 70 placed by the owner of the shirt 18 in the midportion of the inside surface 12 of the neck band 14, as explained below in connection with the use of the protector.

In the use of the invention, the user of the shirt 18 measures off the midportion of the inside surface 12 of the neck band 14 of his shirt 18 by a ruler, and places a dot 70 of indelible ink at that point or, in the alternative, a stitch of thread. To attach the collar protector 10 to the shirt 18, the user peels off the central cover strip 48 from the central adhesive strip 44 and the end cover strips 54 and 55 from the end attachment strips 50 so as to expose the adhesive layers 52 and 53 thereon. He then aligns the central index mark 68 on the protector 10 with the central dot 70 on the neck band 14 and presses the base strip 20 against the inside surface 12 of the neck band 14 of the collar 16 of the shirt 18, at the same time hooking the collar hooks 36, if present, over the upper edge of the collar 16. He then presses the end attachment strips 50 against the adjacent portions of the neck band 14. The shirt 18, thus protected, is ready for use. After the protector 10 has been worn and soiled, it is removed by pulling it away from the neck band 14 in a reversal of the procedure just described for attaching it to the neckband 14. Assuming that the shirt or other garment 18 is still sufficiently clean to be worn again, he then attaches a fresh protector 10 to its neck band 14 and the shirt or other garment 18 is again ready to be worn.

I claim:

1. A garment collar protector comprising an elongated base strip of flexible material having a forward side and a rearward side and a central portion, said rearward side having thereon pressure-sensitive adhesive means adapted to detachably secure said base strip to the inner side of the garment collar near the upper edge thereof, an elongated collar protector strip of flexible moisture-absorbed material secured to said base strip adjacent its upper edge and extending along its central portion, and an elongated facing strip of flexible material secured to the forward side of said base strip, said protector strip being reversely bent into elongated forward and rearward portions secured respectively to said forward and rearward sides of said base strip.

2. A garment collar protector, according to claim 1, wherein the upper edge of said protector strip projects above the adjacent upper edge of said base strip, wherein said central portion of said base strip also projects above the upper edges of the remainder of said base strip coextensively with said protector strip, and wherein said protector strip is secured to the upwardly projecting central portion of said base strip.

3. A garment collar protector, according to claim 1, wherein said facing strip has an elongated central cutaway portion extending downward from its upper edge and exposing said protector strip therein.

* * * * *